US005255996A

United States Patent [19]

Kiat et al.

[11] Patent Number: 5,255,996

[45] Date of Patent: Oct. 26, 1993

[54] METHOD OF CONSTRUCTING A ROADWAY

[76] Inventors: Ong S. Kiat, 36A Jalan SS 21/62, Damansara Utama, 47400 Petaling Jaya, Selangor, Malaysia; Lam H. Beng, deceased, late of Darul Ehsan; by Yap S. Chee, personal representative, No. 108, Jalan SS30/26, Damansara Utama, Petaling Jaya, Selangor, Darul Ehsan, Malaysia

[21] Appl. No.: 783,008

[22] Filed: Oct. 28, 1991

[30] Foreign Application Priority Data

Dec. 27, 1990 [MY] Malaysia ..... P1-9002280
Apr. 18, 1991 [GB] United Kingdom ..... 9108272

[51] Int. Cl.[5] ..... E01C 3/00; E01C 11/02

[52] U.S. Cl. ..... 404/43; 404/51; 404/53; 14/14

[58] Field of Search ..... 404/43, 51, 53; 14/1, 14/14; 52/181

[56] References Cited

U.S. PATENT DOCUMENTS

| | | | |
|---|---|---|---|
| 33,616 | 10/1861 | Stebbins | 404/43 |
| 113,787 | 4/1871 | New | 404/43 |
| 776,419 | 11/1904 | Platt | 404/43 |
| 2,120,802 | 6/1938 | Focht | 404/43 X |
| 3,065,506 | 11/1962 | Tremer | 404/43 X |
| 3,213,768 | 10/1965 | Jensen | 404/43 |
| 3,260,023 | 7/1966 | Nagin | 404/43 X |

*Primary Examiner*—Kenneth J. Dorner
*Assistant Examiner*—Nancy P. Connolly
*Attorney, Agent, or Firm*—Fish & Richardson

[57] ABSTRACT

A method of constructing a paved surface such as a roadway in which piles (8) are placed in the ground (G) and preformed slabs (4) are laid over the piles (8) to form a continuous paved surface. The preformed slabs (4) may be short in length and may be supported at opposite ends by separate beams (6) which comprise the pile caps. In a preferred embodiment, suitable for the construction of an elevated roadway, the method further comprises the steps of supporting preformed structural elements 5, 15 on the piles 8 and supporting the preformed slabs 4 on the preformed structural element 5, 15. The preformed structural elements 5, 15 may be shaped so as to provide an open work structure. Preferably, the preformed structural elements 5, 15 comprise substantially V-shaped channels which are laid with their longitudinal axes at right angles to the longitudinal centrelines of the roadway 2, and with their flanges 14 directed downwards. A plurality of rows of preformed structural elements 5, 15 may be stacked one above the other to achieve the desired elevation of the roadway 2. In addition, the size of successive preformed structural elements 5*a*, 5*b*, 15*a*, 15*b* may be gradually varied to provide the finished roadway 2 with the desired gradient.

7 Claims, 7 Drawing Sheets

METHOD OF CONSTRUCTING A ROADWAY

BACKGROUND OF THE INVENTION

The present invention relates to a method of constructing a roadway. A roadway in this specification means a highway or other paved surface (e.g. a runway).

Conventional methods for constructing a roadway involve the excavation of large volumes of material, so that a complicated system of supporting strata can be laid and compacted beneath the paved surface, to provide a sufficiently stable foundation.

In regions where the ground is soft, even greater volumes of material must be removed, and replaced by foundation material. To ensure that settlement of the eventual paved surface is not excessive, extensive soil investigations are required before work can proceed.

Where it was necessary to raise the level of the roadway, this has previously been achieved by compacting earth fill or by constructing a multi-span bridge structure onto which was laid a road surface. A common problem with earth filled embankments is to find a suitable source of earth. Often the earth must be transported a considerable distance to the required site. The cost of construction is therefore very high. In addition, the earth fill method requires the imported earth to be properly compacted to the required level and this normally takes a considerable time since the compaction procedure requires the compaction of many individual layers of fill. A further complication is the need to provide culverts to maintain the natural water flow underneath the embankment. Despite these many disadvantages the earth fill method of embankment construction is the most common, since the "bridge" type method of embankment construction is even more expensive.

SUMMARY OF THE INVENTION

According to the present invention there is provided a method of constructing a roadway, the method comprising placing piles in the ground and supporting preformed slabs on the piles.

In order to construct an elevated roadway according to the present invention the method further comprises the step of supporting preformed structural elements on the piles, the preformed slabs being supported on the preformed structural elements.

The preformed slabs and preformed structural elements may be made from precast concrete. The slabs and elements may be reinforced and may also be prestressed. A large supply of slabs or elements can be assembled on site before work begins, and so considerable time can be saved during construction, since the amount of in situ casting may be substantially reduced or eliminated.

In addition, extensive soil investigations are not necessary to ensure that the settlement of the paved surface will be within acceptable limits, since the piles may be arranged to transfer load over a greater depth than known paving methods. The use of a Mackintosh probe to determine the soil conditions has been found sufficient. The length and spacing of the piles can be adjusted to suit the particular strata encountered, to ensure that the load is transferred to stronger deeper lying strata, and to minimise differential settlement.

Where the roadway does not need to be elevated so that no preformed structural elements are necessary, preferably each slab is short in length and is supported directly on respective low bearing capacity piles at the ends only of the slab. Since the span between supports is kept short, the piles, pile cap beams and slabs are all easily manageable and transportable.

It is also possible to create a roadway with a smooth gradually changing gradient using flat slabs, provided that the slabs are short in length. If necessary, curved slabs could be used to enhance the ride quality.

The amount of excavation required using a piled foundation system is greatly reduced and backfill does not require the same degree of compaction. The cost of construction is therefore further reduced, as is the likelihood of work being suspended due to adverse weather conditions.

Where preformed structural elements are required to elevate the road surface, preferably each preformed structural element extends between adjacent piles in the lengthwise direction of the roadway. The preformed structural elements preferably have a shape which results in an open work structure between the piles and the preformed slabs. For example, each preformed structural element may comprise a web provided with flanges which project laterally from the web. The flanges preferably extend from opposite edges of the web and are diected to the same side of the web.

In a preferred embodiment the flanges diverge in the direction away from the web so that the preformed structural elements comprise substantially V-shaped channels which are laid with their longitudinal axes extending transversely of the longitudinal centreline of the embankment or raised roadway. The V-shaped elements are preferably laid inverted, and are supported at the end of each flange or leg on a separate pile cap. Preferably, each pile cap supports respective legs of two adjacent V-shaped elements placed side by side.

Since the span between supports is kept short, the piles, pile cap beams, structural elements and slabs are all easily manageable and transportable and, since these elements are all precast, construction can be made a continuous process which does not suffer from delays whilst large volumes of newly cast concrete cure on site. The overall speed of construction is therefore greater than by a conventional system.

A further advantage of using precast elements and slabs is that quality control at the casting and curing stages is extremely good, whilst the unit cost of the precast elements and slabs is kept low. The high quality and dimensional accuracy of the precast elements and slabs makes assembly of the roadway and the laying of asphaltic road surfacing easier, and hence improves the ride quality of the finished roadway.

Construction using preformed elements avoids the problems of obtaining, transporting and compacting fill as described above and also eliminates the settlement problems normally encountered in earth fill embankments. In addition, the requirement for providing culverts is effectively eliminated since water can pass freely through the hollow channels of the precast element. Indeed, the natural flow of surface water present before construction, is hardly effected by an embankment or raised roadway according to the present invention.

The environmental advantages of using precast elements to form a raised roadway are significant when compared to the traditional earth fill method, particularly since a far narrower area of land is required to construct an embankment in this way. The overall width of the embankment is also no greater than if a bridge type method is used.

The height of the raised roadway above the ground may be increased by stacking a plurality of rows of preformed structural elements one above the other. In addition, the raised roadway may be provided with a predetermined gradient by successively varying the size of adjacent preformed structural elements.

BRIEF DESCRIPTION OF THE DRAWINGS

For a better understanding of the present invention, and to show how it may be carried into effect, reference will now be made, by way of example, to the accompanying drawings, in which.

DESCRIPTION OF THE PREFERRED EMBODIMENTS

Figure 1:
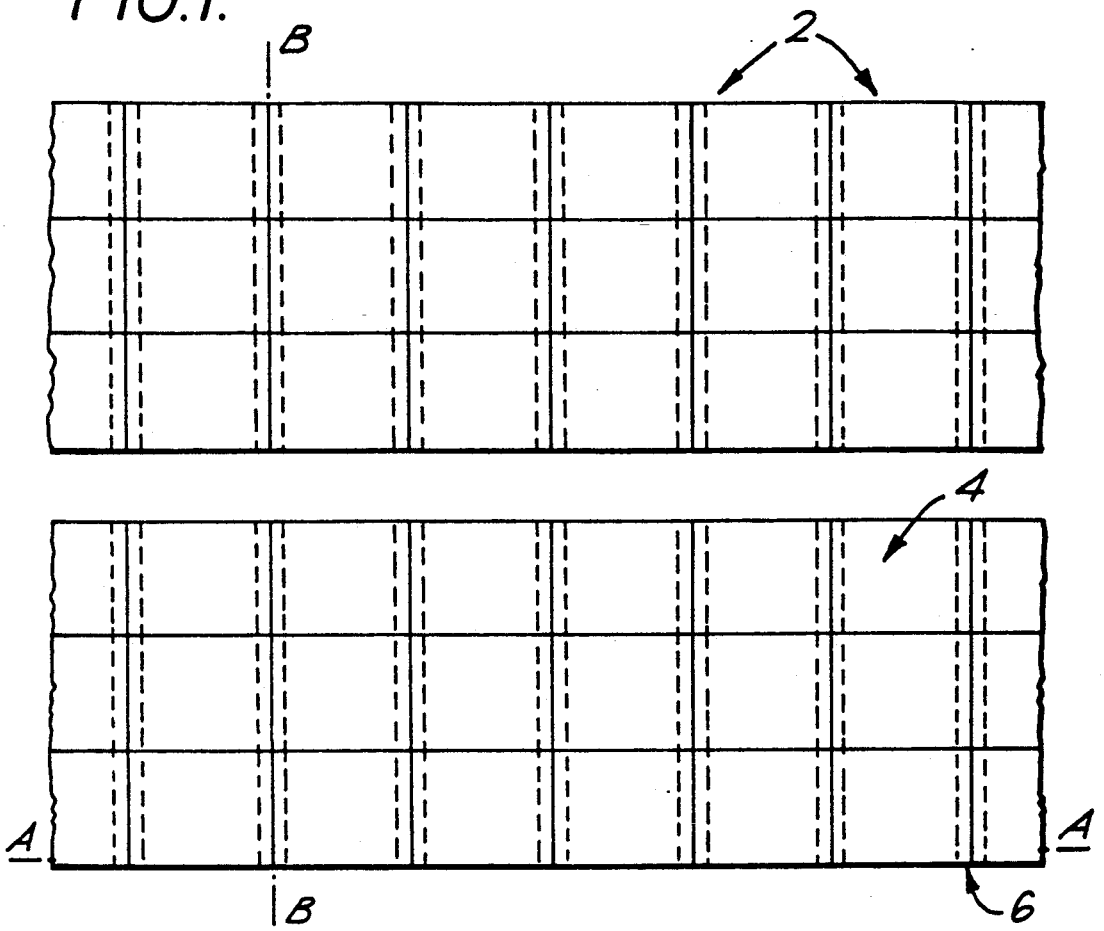
FIG. 1 is a plan view of a roadway.
Figure 2:
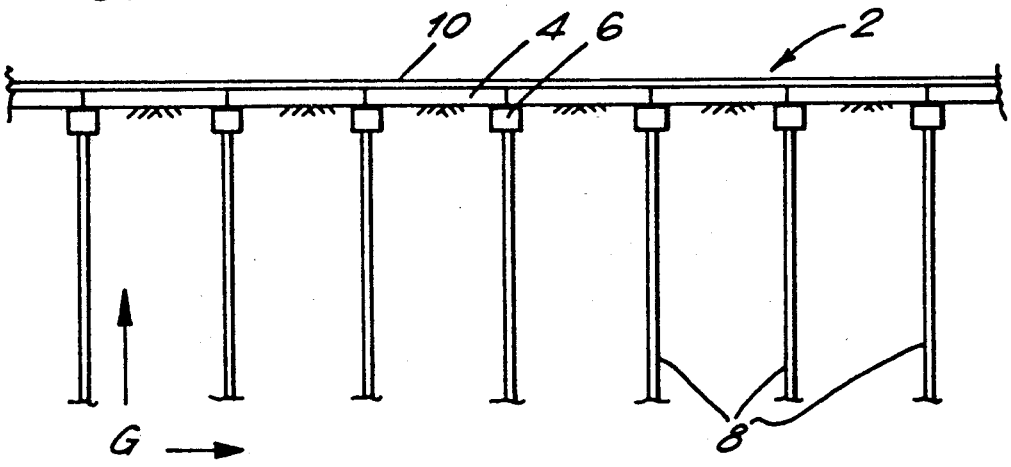
FIG. 2 is a side view of the roadway taken along line AA in FIG. 1.
Figure 3:
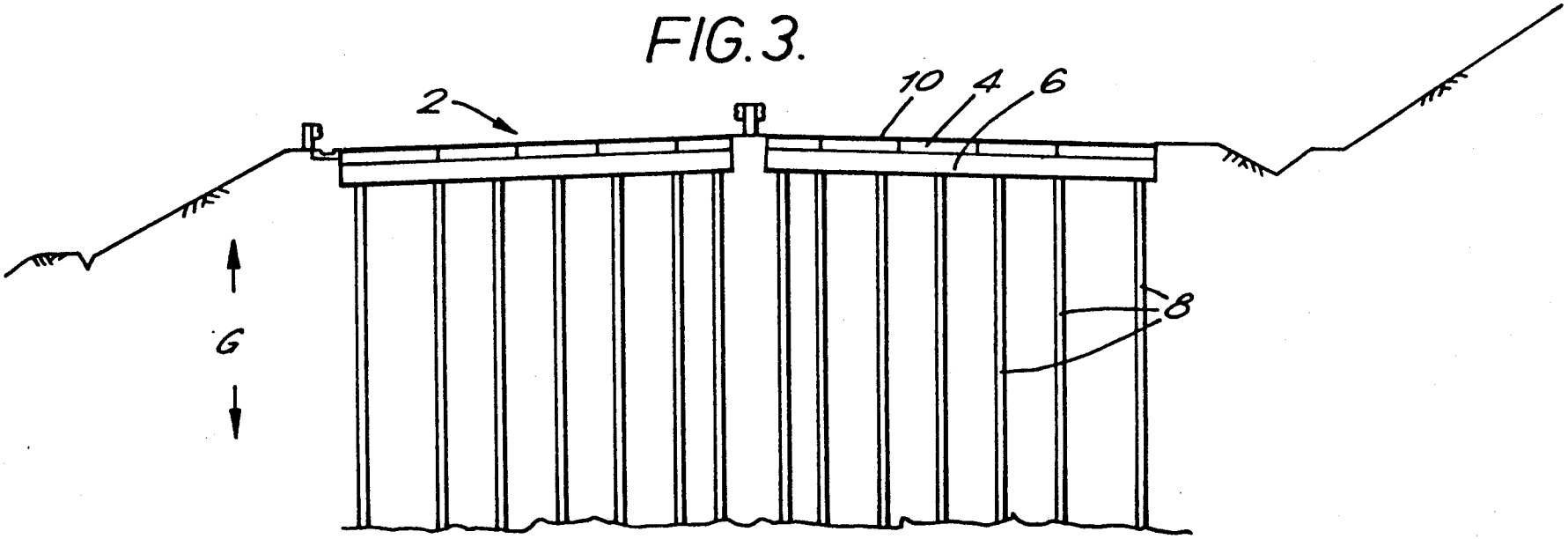
FIG. 3 is a cross-section through the roadway taken along line BB in FIG. 1.

Referring to FIGS. 1 to 3, a roadway 2 comprises precast reinforced concrete slabs 4 supported on precast reinforced concrete pile cap beams 6. Beams 6 are connected to the tops of precast reinforced concrete piles 8 driven into the ground G by means of a conventional jack-in piling system. An asphaltic layer 10 is laid over slabs 4 by a known process and provides a smooth continuous road surface.

Figure 4:
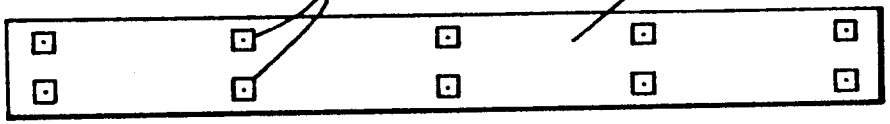
FIG. 4 shows the layout of piles beneath a pile cap beam.

FIG. 4 shows the distribution of piles 8 beneath a pile cap beam 6. In the embodiment shown, piles 8 are disposed in pairs at equal intervals along the length of pile cap beam 6.

Figure 5:
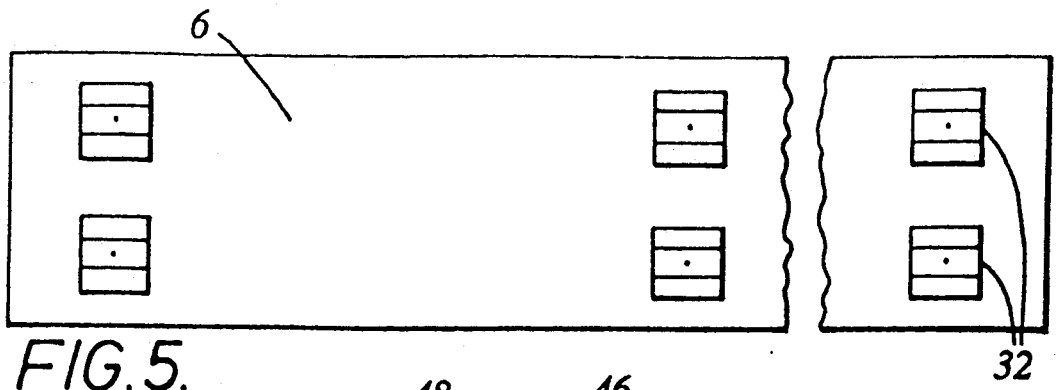
FIG. 5 is an enlarged fragmentary view of the pile cap beam.
Figure 6:
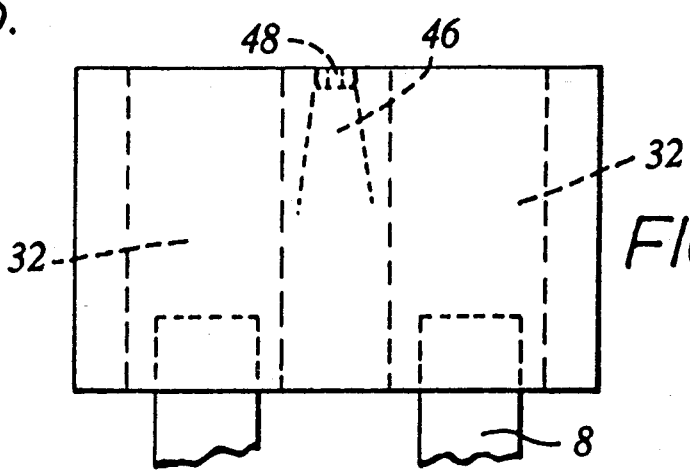
FIG. 6 shows the pile cap beam positioned over the piles.

As shown in FIG. 5, pile cap beam 6 is provided with openings 32 when it is cast. The size and spacing of openings 32 correspond to the size and spacing of piles 8, so that pile cap beams 6 fit freely over exposed ends 44 of piles 8. FIG. 6 shows a pile cap beam 6 in place over a pair of piles 8. A tapered opening 46 is cast into pile cap beam 6 to accommodate a fixing nut 48.

Figure 7:
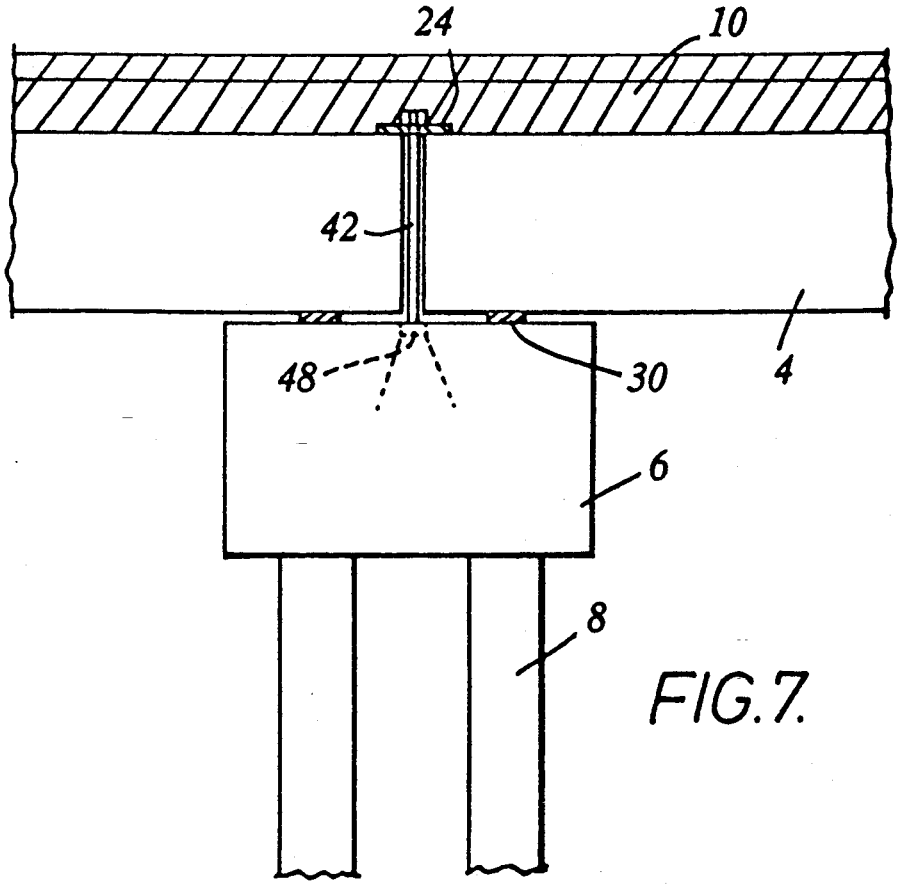
FIG. 7 is a detailed side view of the roadway.

FIG. 7 shows in detail the assembled structure of roadway 2. After positioning pile cap beam 6 over piles 8, concrete is poured into openings 32 and is compacted by vibration. Laminated elastomeric bearing strips 30 are then laid onto pile cap beams 6 and slabs 4 are laid end to end on top of strips 30. Strips 30 are used to ensure that slabs 4 rest evenly on pile cap beams 6. A bolt 42, provided with a washer 24, is inserted between the end of slabs 4 into fixing nut 48, and is tightened to secure slabs 4 relative to pile cap beams 6.

Pile cap beam 6 may be set at ground level or a trench may be excavated and pile cap beam 6 set in the trench. Where back filling is necessary, the back-fill does not have to be compacted as much as in conventional roadway construction.

Once slabs 4 are in place and have been properly aligned, an asphaltic concrete road surface 10 is laid on top of slabs 4 in a known manner.

Figure 8:
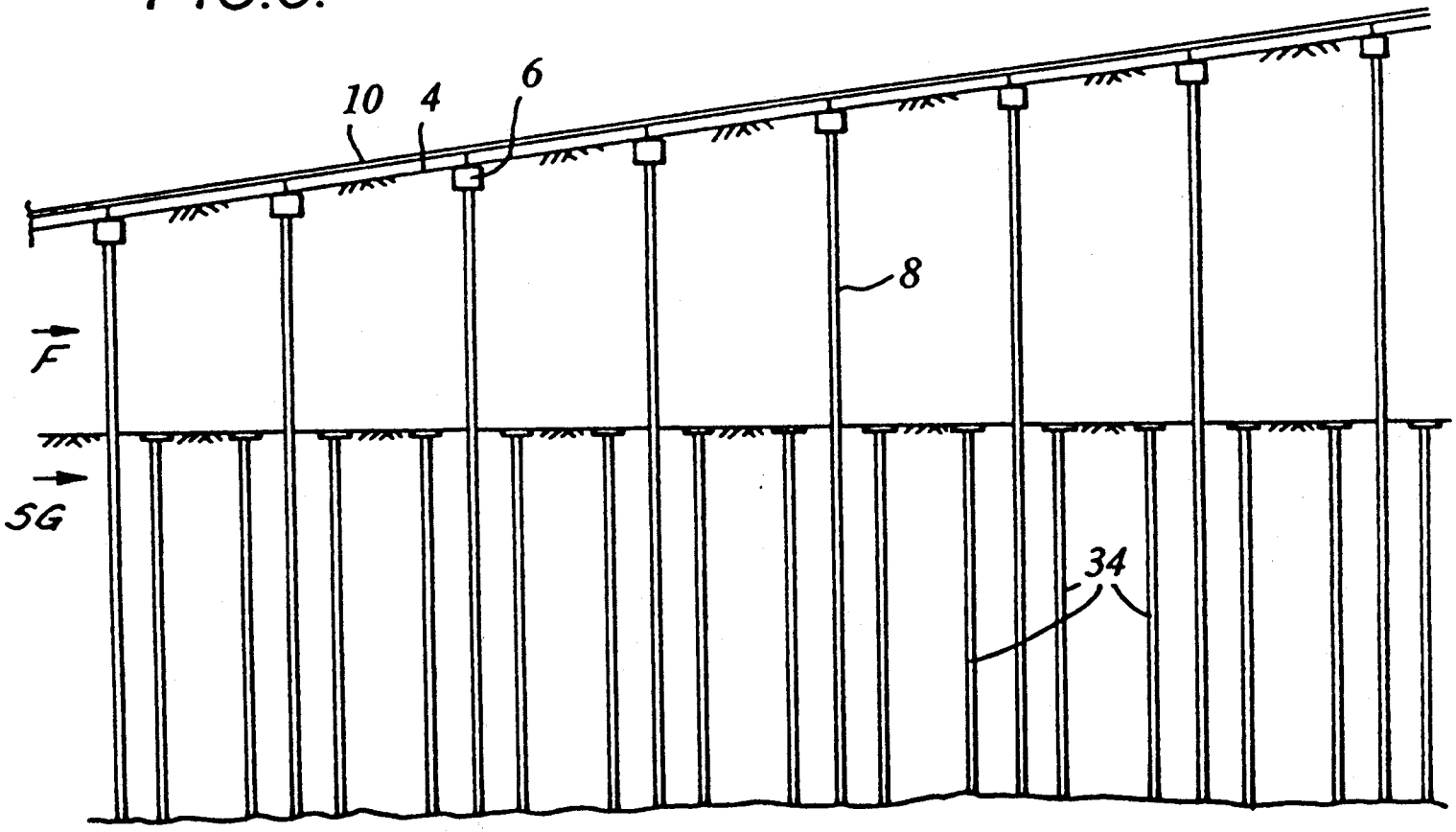
FIG. 8 is an elevation of another form of roadway.

FIG. 8 shows how the present invention can be used to construct a roadway with an even or gradually changing gradient in an area of weak soil strata SG. For example, the roadway may be the approach to a bridge or elevated highway section.

Soft ground piles 34 are driven into the soft ground SG at regular intervals and are then capped. Fill material F is then deposited over the ground SG, is compacted, and the correct gradient established, by known earth moving equipment.

Piles 8 are then driven through the newly formed embankment into the original ground SG. Roadway 2 is then constructed as described above.

Where the loading on the roadway will be very large and where it is desirable for slabs 4 and beams 6 to be slender, they may be made from prestressed concrete.

Ducts may be cast through slabs 4 so that cables and pipes may be passed under roadway 2. If hollow slabs 4 are used, no special ducts are required since the pipes and cables may be passed through the hollow interior of slabs 4.

Figure 9:
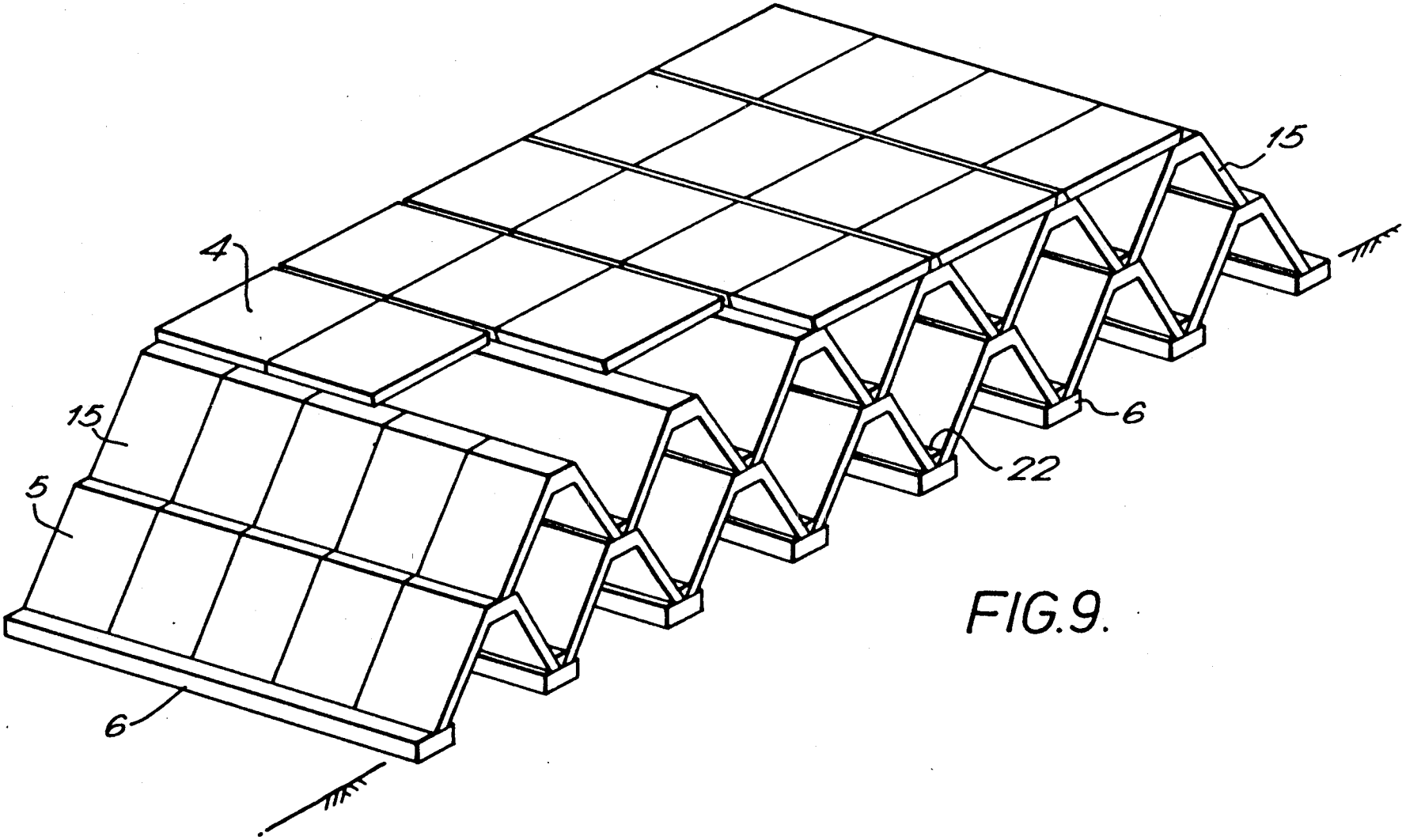
FIG. 9 shows a perspective view of an elevated roadway.
Figure 10:
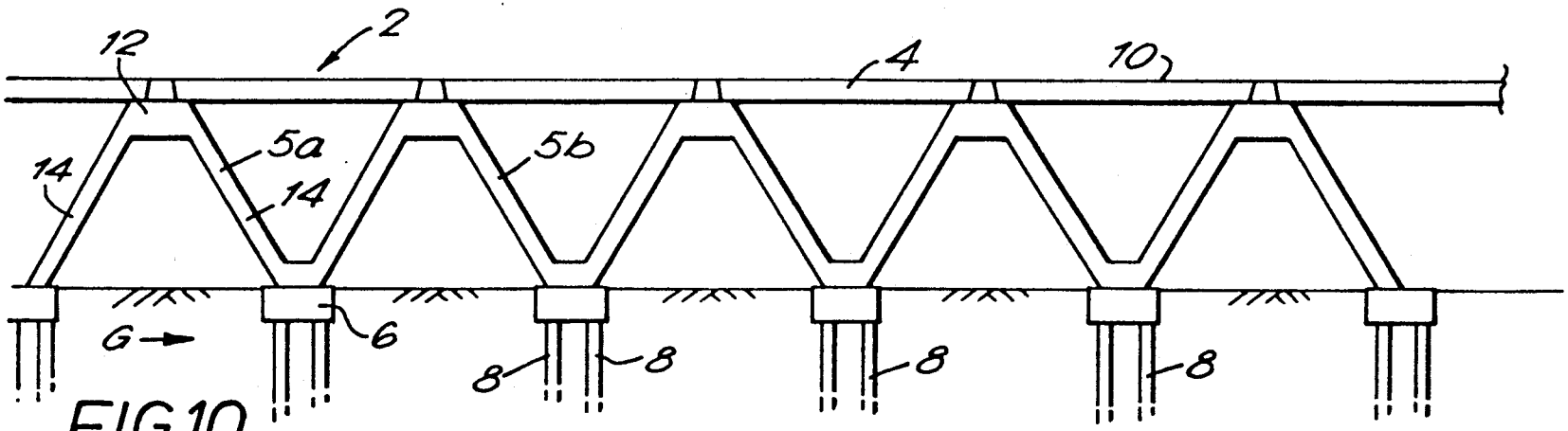
FIG. 10 is a section through the elevated roadway of FIG. 9.

FIGS. 9 and 10 show an alternative embodiment of the invention in which the precast reinforced concrete slabs 4 are supported on preformed elements 5 which are themselves supported on the precast reinforced concrete pile cap beams 6. As in the previous embodiment, pile cap beams 6 are connected to the tops of precast reinforced concrete piles 8 driven into the ground G by means of a conventional jack-in piling system. Asphaltic layer 10 is laid over slabs 4 by a known process and provides a smooth continuous road surface.

Figure 11:
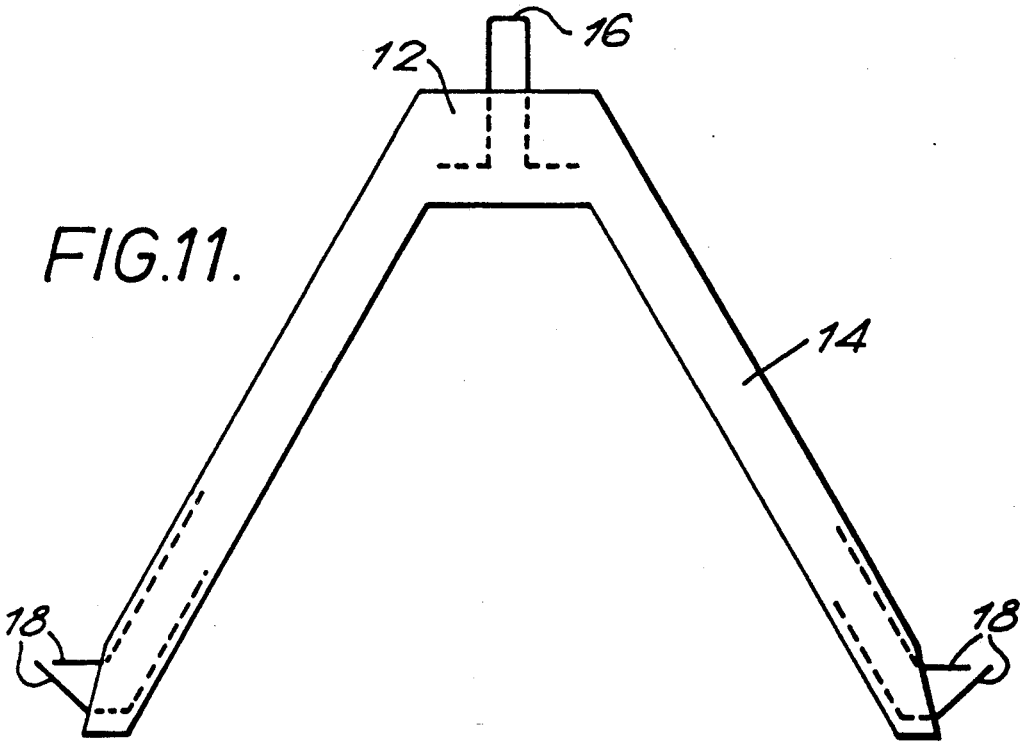
FIG. 11 shows a V-shaped precast concrete element.

FIG. 11 shows an enlarged section view of the preformed element. The preformed element comprises a substantially V-shaped inverted channel 5 precast in reinforced concrete. V-shaped channel or element 5 comprises a web 12 and two flanges 14 which project from either end of web 12 at approximately 45°. V-shaped element 5 is reinforced or prestressed by conventional methods according to its design loading. During casting of V-shaped elements 5 additional steel reinforcement bars 16, 18 are cast into web 12 and the ends of flanges 14 furthest from web 12. Reinforcement bars 16, 18 project outwardly from V-shaped element 5. Typically, V-shaped element will be 2 to 4 metres high and 2.5 to 3.5 metres wide, and flanges 14 will be approximately 0.25 m thick.

Figure 12:
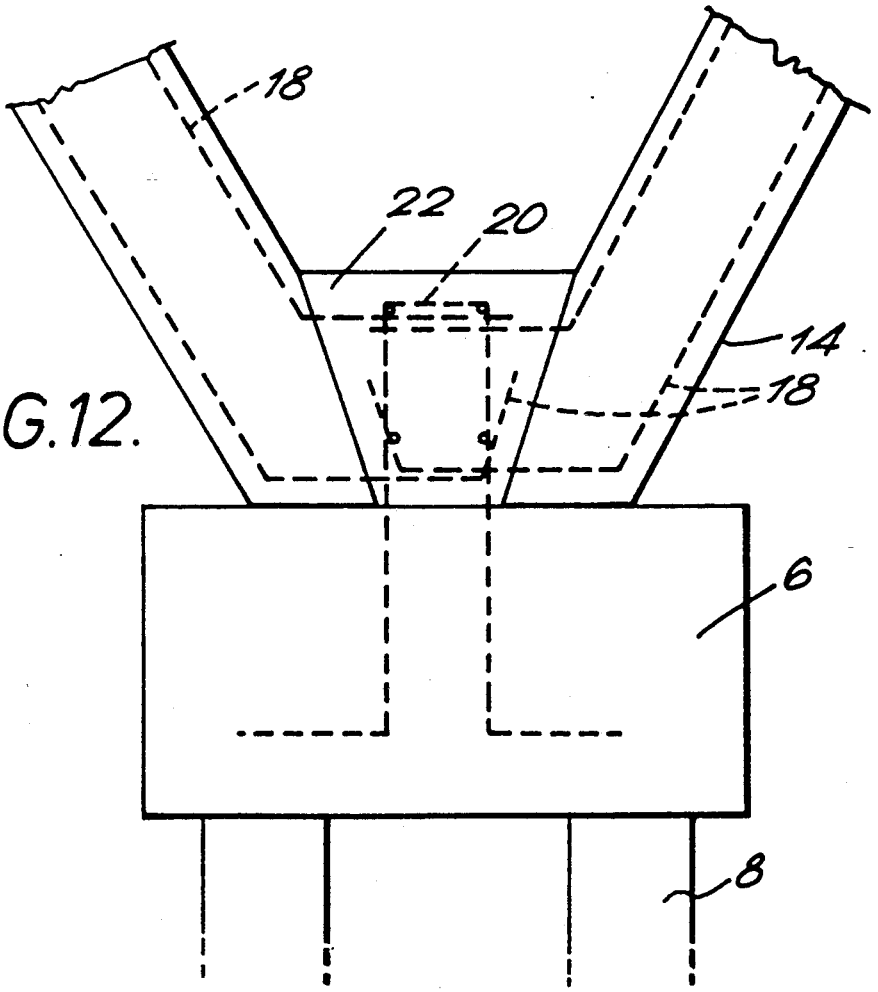
FIG. 12 shows the joint detail between two adjacent V-shaped reinforced concrete elements and a pile cap.

FIG. 12 shows how reinforcement bars 18, projecting from flanges 14 of adjacent V-shaped elements **5*a*, 5*b*, cooperate with a pile cap beam 6. Each pile cap beam 6 is provided with anchoring reinforcement strip 20 which is embedded in, and projects from, the central portion of the top surface of pile cap beam 6. A respective flange 14 of adjacent V-shaped elements 5*a*, 5*b* rests on either side of anchoring reinforcement strip 20 on the top surface of pile cap beam 6, so that projecting reinforcement bars 18 in the foot of a flange 14 of the first V-shaped element 5*a* cooperates with reinforcement bars 18 in the foot of flange 14 of an adjacent V-shaped element 5***b*, and also with anchoring reinforcement strip 20 which projects from pile cap beam 6. Cooperating and interlocking reinforcements 18, 20 are bonded together by a reinforced concrete joint 22 which is cast in situ. Thus, each pile cap beam 6 supports respective flanges 14 of adjacent V-shaped elements 5*a*, 5*b*.

Slabs 4 are supported between two adjacent webs 12 of successive V-shaped elements 5*a*, 5*b* and are held in place by reinforced concrete joints 22 cast in situ around reinforcement 16 projecting from the top of each web 12.

Alternatively, a fixing nut may be cast into the top of web 12 in place of the reinforcement 16. Laminated elastomeric bearing strips 20 may be placed between the upper surface of webs 12 and the lower surface of slabs 4 to ensure that slabs 4 rest evenly on webs 12 of V-shaped elements 5. Bolts provided with washers pass through slabs 4 and engage the fixing nuts in webs 12, thereby securing slabs 4 relative to webs 12.

Where a greater elevation of the roadway is required a further row of V-shaped elements 15 may be cast on to webs 12 of the first row of V-shaped elements 5. A plurality of rows of V-shaped elements may be stacked one above the other in this manner to give the desired elevation, the number of rows being limited by the stability of the structure and by the loads imposed on lower V-shaped elements 5*a*, 5*b*.

Figure 13:
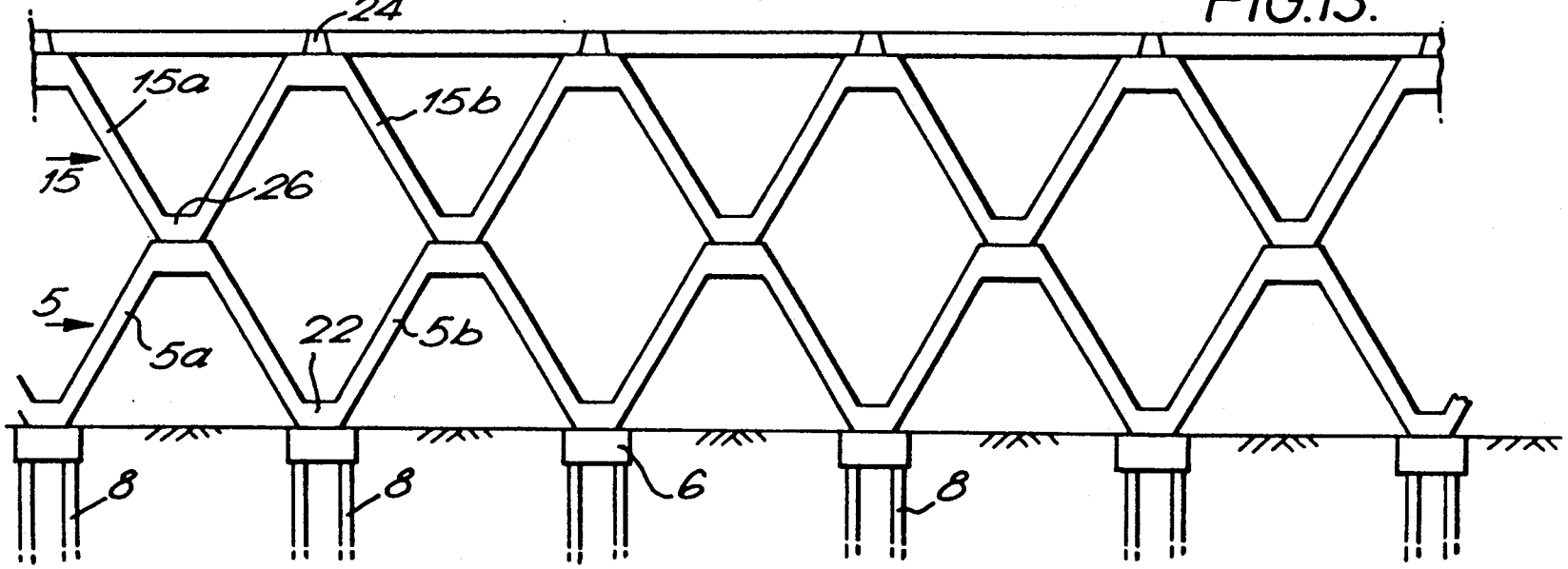
FIG. 13 shows how the V-shaped precast concrete elements may be stacked.

FIG. 13 shows two rows of V-shaped elements 5, 15 stacked one above the other. The joints between V-shaped elements 5, 15 of the lower and upper rows are similar to those between the feet of flanges 14 of the lower row of V-shaped elements 5 and pile cap beam 6. An in situ joint 26 is cast between respective flanges 14 of adjacent V-shaped elements 15*a*, 15*b* in the upper row, over reinforcement 16 projecting from web 12 of lower V-shaped element 5 and reinforcement bars 18 projecting from flanges 14 of adjacent V-shaped elements 15*a*, 15*b*.

It should be noted that any combination of size, shape and distribution of piles, pile cap beams 6, preformed elements 5 and slabs 4 is contemplated, depending on the particular soil conditions encountered and the type of roadway required.

Other embodiments are within the claims.

What is claimed is:

1. A method of constructing a roadway, comprising the steps of:

providing piles;

providing pile caps adapted to be installed upon upper ends of the piles;

placing the piles in the ground to a designed depth whereby pile caps installed upon the piles are at ground level;

installing the pile caps upon upper ends of the piles;

supporting preformed structural element on the pile caps at ground level, each preformed structural element comprising a web provided with flanges, the flanges projecting laterally and extending downwardly from the web, and diverging from each other in the downwards direction, and the preformed structural elements extending transversely of the longitudinal center line of the roadway; and supporting preformed slabs on the preformed structural elements.

2. A method of constructing a roadway, comprising the steps of:

providing piles;

providing pile caps adapted to be installed upon upper ends of the piles;

placing the piles in the ground to a designed depth whereby pile caps installed upon the piles are at ground level;

installing the pile caps upon upper ends of the piles;

supporting preformed structural element on the pile caps at ground level, each preformed structural element comprising a web provided with flanges which project laterally from the web; and supporting the flanges on the piles at their ends furthest from the web.

3. A method of constructing a roadway, comprising the steps of:

providing piles;

providing pile caps adapted to be installed upon upper ends of the piles;

placing the piles in the ground to a designed depth whereby pile caps installed upon the piles are at ground level;

installing the pile caps upon upper ends of the piles;

supporting preformed structural element on the pile caps at ground level, each preformed structural element comprising a web provided with flanges which project laterally from the web; and joining together and bonding respective elongate flanges of adjacent preformed structural elements to the pile cap beam by means of an in situ cast concrete joint.

4. A method of constructing a roadway, comprising the steps of:

providing piles;

providing pile caps adapted to be installed upon upper ends of the piles;

placing the piles in the ground to a designed depth whereby pile caps installed upon the piles are at ground level;

installing the pile caps upon upper ends of the piles; and supporting preformed structural element on the piles; and supporting preformed slabs on the preformed structural elements;

said method comprising the further step of:

stacking a plurality of rows of preformed structural elements one above the other.

5. A method of constructing a roadway, comprising the steps of:

providing piles;

providing pile caps adapted to be installed upon upper ends of the piles;

placing the piles in the ground to a designed depth whereby pile caps installed upon the piles are at ground level;

installing the pile caps upon upper ends of the piles;

supporting preformed structural element on the pile caps at ground level, each preformed structural element comprising a web provided with flanges which project laterally from the web;

stacking a plurality of rows of preformed structural elements one above the other; and supporting, with the web of a lower preformed structural element, respective flanges of two higher adjacent preformed structural elements.

6. A method of constructing a roadway, comprising the steps of:

providing piles;

providing pile caps adapted to be installed upon upper ends of the piles;

placing the piles in the ground to a designed depth whereby pile caps installed upon the piles are at ground level;

installing the pile caps upon upper ends of the piles;

supporting preformed structural elements on the piles;

providing preformed slabs, each said preformed slab having a pair of opposite side edges; and supporting said preformed slabs on the preformed structural elements, each said preformed slab being supported only at regions of said pair of opposite side edges of the slab.

7. A method of constructing a roadway, comprising the steps of:

providing piles;

providing pile caps adapted to be installed upon upper ends of the piles;

placing the piles in the ground to a designed depth whereby pile caps installed upon the piles are at ground level;

installing the pile caps upon upper ends of the piles;

supporting preformed structural element on the pile caps at ground level, each preformed structural element comprising a web provided with flanges, the flanges projecting laterally and extending downwardly from the web, and the preformed structural elements extending transversely of the longitudinal center line of the roadway; and supporting preformed slabs on the preformed structural elements.

* * * * *